US011371358B2

(12) United States Patent
Chakrabarti et al.

(10) Patent No.: US 11,371,358 B2
(45) Date of Patent: Jun. 28, 2022

(54) TURBINE DAMPER

(71) Applicant: General Electric Company, Schenectady, NY (US)

(72) Inventors: Suryarghya Chakrabarti, Niskayuna, NY (US); Jing Li, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/794,732

(22) Filed: Feb. 19, 2020

(65) Prior Publication Data

US 2021/0254478 A1 Aug. 19, 2021

(51) Int. Cl.
*F01D 5/16* (2006.01)

(52) U.S. Cl.
CPC ..... *F01D 5/16* (2013.01); *F05D 2220/30* (2013.01); *F05D 2260/96* (2013.01)

(58) Field of Classification Search
CPC ..... F01D 5/16; F05D 2220/30; F05D 2260/96
See application file for complete search history.

(56) References Cited

U.S. PATENT DOCUMENTS 1,833,751 A * 11/1931 Kimball ..... F01D 5/16 416/222
2,984,453 A * 5/1961 Heymann ..... F01D 5/16 416/229 R
2,999,669 A * 9/1961 McGinnis ..... F01D 5/16 416/229 R
3,240,468 A * 3/1966 Watts ..... F01D 5/183 415/117
3,966,357 A 6/1976 Corsmeier
4,802,823 A * 2/1989 Decko ..... F01D 5/147 416/97 A
5,165,860 A 11/1992 Stoner et al.
5,232,344 A 8/1993 El-Aini
5,407,321 A * 4/1995 Rimkunas ..... F01D 5/16 415/119
5,558,497 A 9/1996 Kraft et al.
5,947,688 A * 9/1999 Schilling ..... F01D 5/147 416/233
6,033,186 A * 3/2000 Schilling ..... B64C 11/00 416/233
6,283,707 B1 9/2001 Chin
(Continued)

FOREIGN PATENT DOCUMENTS

WO 2015112891 A1 7/2015

OTHER PUBLICATIONS

European Search Report for corresponding EP Application No. 20211380.9, dated May 11, 2021.

*Primary Examiner* — J. Todd Newton
*Assistant Examiner* — Theodore C Ribadeneyra
(74) *Attorney, Agent, or Firm* — Dority & Manning, P.A.

(57) ABSTRACT

A turbine damper may be provided that may include an elongated body sized to fit inside a turbine blade, the elongated body elongated along a radial direction of the turbine blade relative to a rotation axis of the turbine blade, and plural dampening masses coupled with the elongated body and disposed at different locations along the radial direction. The plural dampening masses may be one or more of sized to dampen different vibration modes of the turbine blade, or moveable relative to and along the elongated body in the radial direction.

19 Claims, 5 Drawing Sheets

(56) References Cited

U.S. PATENT DOCUMENTS 6,827,551 B1* 12/2004 Duffy ..... F01D 5/16 415/119
6,929,451 B2 8/2005 Gregg et al.
7,125,225 B2 10/2006 Surace et al.
7,217,093 B2 5/2007 Propheter et al.
7,270,517 B2 9/2007 Garner
7,413,405 B2 8/2008 Busbey et al.
7,736,124 B2 6/2010 Bauer et al.
7,824,158 B2 11/2010 Bauer et al.
8,267,662 B2 9/2012 Patrick et al.
8,292,583 B2 10/2012 Marra
8,579,593 B2 11/2013 Campbell et al.
8,763,360 B2* 7/2014 Murdock ..... F01D 5/26 60/226.1
8,915,718 B2 12/2014 Dolansky et al.
9,249,668 B2 2/2016 Fisk et al.
9,840,916 B2 12/2017 Stiehler et al.
10,151,204 B2 12/2018 Houston et al.
10,914,320 B2 2/2021 Twelves, Jr. et al.
2004/0151592 A1* 8/2004 Schreiber ..... F04D 29/324 416/231 R
2010/0232968 A1* 9/2010 Miller ..... F01D 5/16 416/190
2013/0058785 A1* 3/2013 Kellerer ..... F01D 5/16 416/1
2013/0276455 A1* 10/2013 Fisk ..... F01D 5/16 60/805
2013/0276457 A1* 10/2013 Houston ..... B22F 10/20 60/805
2013/0280045 A1 10/2013 Dolansky et al.
2014/0112769 A1* 4/2014 Schoenenborn ..... F01D 5/18 415/185
2015/0361801 A1* 12/2015 Blaney ..... F01D 5/26 416/232
2016/0130953 A1* 5/2016 Brandl ..... F01D 5/186 416/95
2016/0222821 A1* 8/2016 Klinetob ..... F04D 29/542
2016/0319669 A1* 11/2016 Morris ..... F01D 5/16
2016/0333710 A1* 11/2016 Klinetob ..... F01D 5/16
2017/0044910 A1* 2/2017 Hartung ..... F01D 5/16
2017/0130585 A1* 5/2017 Kray ..... F01D 5/147
2017/0183972 A1* 6/2017 McDufford ..... F01D 5/147
2017/0190414 A1* 7/2017 Andrews ..... B64C 27/001

* cited by examiner

TURBINE DAMPER

GOVERNMENT LICENSE RIGHTS

This invention was made with government support under contract number DE-FE0031613 awarded by the Department of Energy. The government has certain rights in the invention.

FIELD

Embodiments of the subject matter described herein relate to dampening elongated bodies that reduce or eliminate vibrations of blades in rotor assemblies.

BACKGROUND

Rotor assemblies are used in various systems, such as gas turbine engines and turbochargers. In a gas turbine engine, pressurized air that is produced in a compression system is mixed with fuel in a combustor and ignited, generating hot combustion gases which flow through one or more turbine stages. The turbine stages extract energy from the hot combustion gases for generating engine thrust to propel a vehicle (e.g., a train, an aircraft, a marine vessel, etc.) or to power a load, such as an electrical generator.

The gas turbine includes a rotor assembly having a plurality of blades extending radially outward from a rotor disk. Large industrial gas turbine (IGT) blades are exposed to unsteady aerodynamic loading, causing the blades to vibrate. If these vibrations are not adequately damped, they may cause high cycle fatigue and premature failure in the blades. Of all the turbine stages, the last-stage blade (LSB) is the tallest and therefore is the most vibrationally challenged component of the turbine. Vibration damping methods for turbine blades include platform dampers, damping wires, shrouds etc. However, each method includes drawbacks.

For example, platform dampers sit underneath the blade platform and are effective for medium and long shank blades which have motion at the blade platform. IGT aft-stage blades have short shanks to reduce the weight of the blade and in turn reduce the pull load on the rotor which renders platform dampers ineffective. Meanwhile, tip shrouds, and in particular part-span-shroud blades have a high contact load that may prevent the shroud contact surfaces from sliding and providing damping. While a second part span shroud may be added, the second part span shroud adds weight and may reduce performance of the rotor assembly.

BRIEF DESCRIPTION

In an embodiment, a turbine damper may be provided that may include an elongated body sized to fit inside a turbine blade, the elongated body elongated along a radial direction of the turbine blade relative to a rotation axis of the turbine blade, and plural dampening masses coupled with the elongated body and disposed at different locations along the radial direction. The plural dampening masses may be one or more of sized to dampen different vibration modes of the turbine blade, or moveable relative to and along the elongated body in the radial direction.

In another embodiment, a turbine damper may be provided that may include an elongated body that may be sized to fit inside a turbine blade, the elongated body elongated along a radial direction of the turbine blade relative to a rotation axis of the turbine blade, and plural dampening masses may be coupled with the elongated body and disposed at different locations along the radial direction, wherein the dampening masses are sized to dampen different vibration modes of the turbine blade.

In another embodiment, a turbine damper may be provided that may include an elongated body that may be sized to fit inside a turbine blade, the elongated body elongated along a radial direction of the turbine blade relative to a rotation axis of the turbine blade, and plural dampening masses coupled with the elongated body and disposed at different locations along the radial direction, The dampening masses may be moveable relative to and along the elongated body in the radial direction.

BRIEF DESCRIPTION OF THE DRAWINGS

The subject matter described herein will be better understood from reading the following description of non-limiting embodiments, with reference to the attached drawings, wherein below.

DETAILED DESCRIPTION

One or more embodiments described herein provide turbine dampers for a rotor. The turbine dampers may be located within each blade of a blade assembly for a turbine and comprise an elongated body and dampening masses spaced along the elongated body. In some embodiments, the dampening masses may move in relation to the elongated body and move between mass stops also disposed within the blade. The mass stops may be secured to the elongated body or formed from a housing encasing the elongated body. The movable dampening masses function to provide friction dampening for the blade. Alternatively, the dampening masses may be fixed to the elongated body and not moveable along the elongated body. By being fixed to the elongated body, the dampening masses provide impact dampening within the blade. Thus, by providing the turbine dampers within each blade, tip shrouds used for dampening may be eliminated.

Figure 1:
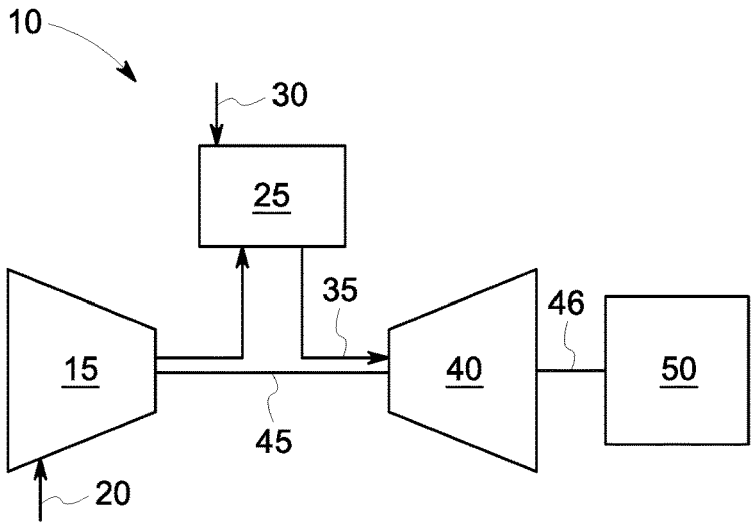
FIG. 1 shows a schematic view of a gas turbine engine system according to an embodiment which includes a compressor, a combustor, and a turbine.

FIG. 1 shows a schematic view of a gas turbine engine system 10 according to an embodiment which includes a compressor 15, a combustion system 25, and a turbine 40. The compressor and turbine may include rows of blades that are axially stacked in stages. Each stage includes a row of circumferentially spaced blades, which are fixed, and a row of rotor blades, which rotate about one or more central shafts.

In operation, the compressor rotor blades rotate about the shaft and, acting in concert with the stator blades, compress a flow of air 20. The compression system delivers the compressed flow of air to a combustion system. The combustion system 25 mixes the compressed flow 20 of air with a pressurized flow of fuel 30 and ignites the mixture to provide a flow of combustion gases 35. The flow of combustion gases may be delivered to the turbine 40. The turbine rotor blades rotate about the shaft and, acting in concert with the stator blades, expand the combustion gases 35 through the turbine 40 so as to produce mechanical work. The mechanical work produced in the turbine 40 drives the compression system 15 via one or more shafts 45 and may drive an external load 50, such as an electrical generator or the like, via one or more shafts 46. The gas turbine engine system 10 may have different shaft, compressor, and turbine configurations and use other types of components in other embodiments. Other types of turbines may also be used.

The embodiments of the rotor assembly described herein may be used in the gas turbine engine system 10, such as on the turbine 40 or the compressor 15. However, the embodiments of the rotor assembly described herein are not limited to use in the engine system 10 shown in FIG. 1, and may be used in other devices, such as turbochargers, HVAC systems, and the like.

Figure 2:
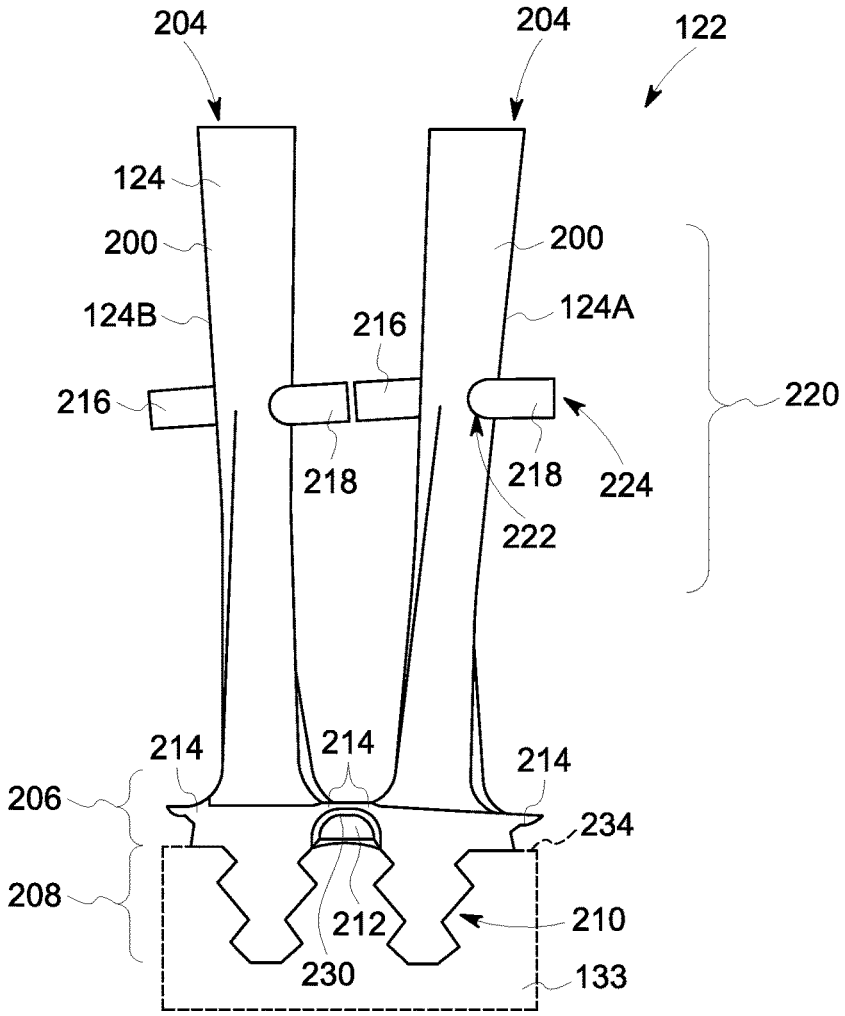
FIG. 2 illustrates a portion of a rotor disk and a pair of blades of a rotor assembly according to one embodiment.

FIG. 2 illustrates a portion of a rotor disk 133 and a pair of blades 124, 124A of a rotor assembly 122 of a turbine according to one embodiment. In one example, the turbine is the turbine illustrated in FIG. 1. Each blade 124, 124A includes portions of a turbine damper disposed therein as will be described in more detail in relation to FIGS. 4-6. Although not shown, the rotor disk 133 has a curved outer periphery, and the rotor assembly 122 further includes additional blades 124 extending radially from the rotor disk 133 at spaced apart locations along the outer periphery of the rotor disk 133. The blades 124 have mounting segments 208 that mount to the rotor disk 133, airfoils 200 that extend from the rotor disk 133, and optionally also include platforms 206 disposed between the airfoil 200 and the mounting segment 208. The platforms 206 extend laterally outward from the corresponding blades 124 towards at least one neighboring (e.g., immediately adjacent) blade 124. The mounting segments 208 are received in corresponding support slots 210 of the rotor disk 133 to mount the blades 124. The mounting segments 208 may be referred to herein as dovetails 208 due to the shapes of the mounting segments 208. The support slots 210 have a complementary shape to the dovetails 208.

Figure 3:
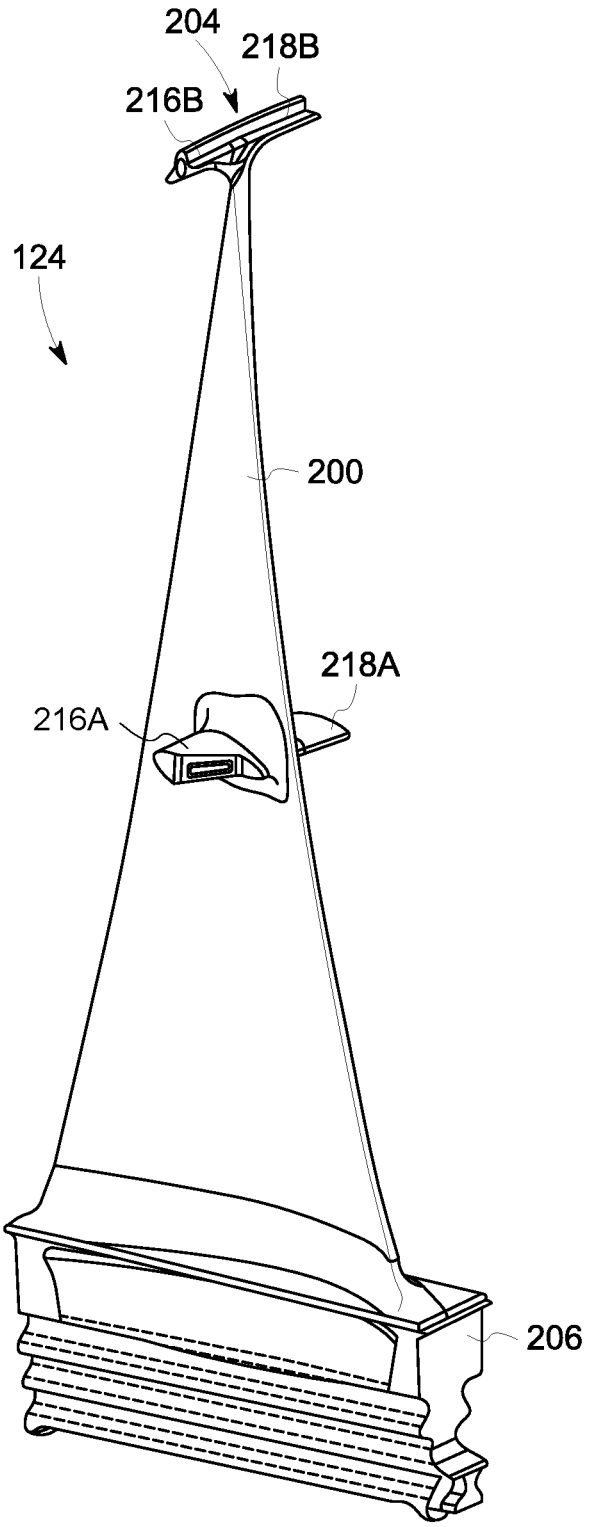
FIG. 3 is a perspective view of a blade of the rotor assembly according to an alternative embodiment.

The airfoils 200 extend from the platforms 206 to distal tips 204 of the airfoils 200. The airfoils 200 receive energy from the gas (e.g., air, exhaust, or the like) flowing through the rotor assembly 122. The blades 124 may have a pair of first and second shrouds 216, 218 that extend outward from the airfoil 200. The shrouds 216, 218 may be located at a common location along a length of the airfoil 200 between the platform 206 and the distal tip 204. In the illustrated embodiment, the shrouds 216, 218 are mid-span shrouds that are located in a medial region 220 of the airfoil 200 that is spaced apart from the distal tip 204 and the platform 206. In an alternative embodiment, the shrouds 216, 218 may be tip shrouds that are located at the distal tips 204 of the airfoils 200. In another alternative embodiment, the blades 124 may include both mid-span shrouds and tip shrouds (FIG. 3). The first and second shrouds 216, 218 in each pair extend in generally opposite directions from the respective airfoil 200. For example, the first shroud 216 may extend from a first side (e.g., a pressure side) of the airfoil 200, and the second shroud 218 extends from an opposite second side (e.g., a suction side) of the airfoil 200. When the rotor assembly 122 is fully assembled, the shrouds 216, 218 of the blades 124 extend circumferentially and define a shroud ring that is concentric with the rotor disc 133. The shrouds 216, 218 are cantilevered, extending from attachment ends 222 connected to the airfoil 200 to distal ends 224 that are remote from the airfoil 200. The distal end 224 of the first shroud 216 of a first blade 124A is disposed at least proximate to the distal end 224 of the second shroud 218 of a neighboring, second blade 124B.

FIG. 3 is a perspective view of a blade of the rotor assembly (shown in FIG. 2) according to an alternative embodiment. The airfoil of the blade extends from the platform to the distal tip. The airfoil includes a first set 302 of mid-span shrouds and a second set 304 of tip shrouds. The first set of mid-span shrouds include mid-span shrouds 216A, 218A. The tip shrouds include a carrier shroud 216B and a lid shroud 218B, which are located at the distal tip 204. Therefore, in some example embodiments, the blade may include multiple sets of shrouds.

Figure 4:
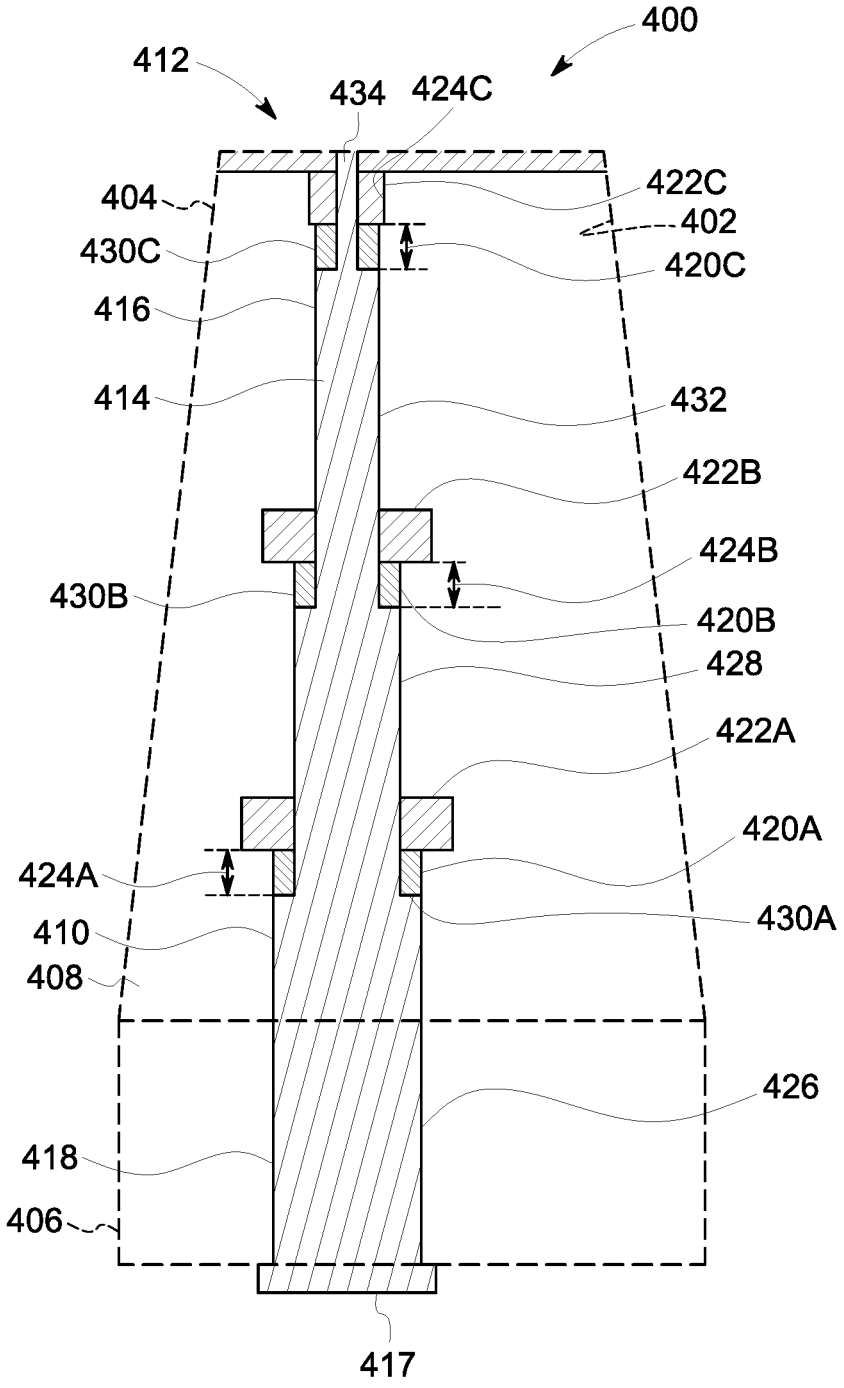
FIG. 4 is a side plan view with hidden lines of a blade assembly according to one embodiment.

FIG. 4 illustrates a blade assembly 400 that includes an airfoil 402 that represents a blade. In one example, the blade assembly 400 may include the blade of FIGS. 2-3. The airfoil 402 extends from a distal tip 404 to a platform 406. The airfoil 402 may be comprised of a housing 408 that includes a hollow interior 410 that extends from the distil tip 404 to the platform 406. When used herein, the housing 408 may refer to both the wall of the air foil itself, or to a separate structure that is within the airfoil and contains a turbine damper 412. In this example embodiment, the housing 408 is the airfoil or blade interior 410. Specifically, disposed within the hollow interior of the housing 408 may be the turbine damper 412 for dampening vibrations of the blade assembly 400.

The turbine damper 412 in the example of FIG. 4 may include an elongated body 414 that extends within the housing 408 from the distal tip 404 to the platform 406. In particular, the elongated body 414 may be elongated along a radial direction of the turbine blade relative to a rotation axis of the turbine blade. The elongated body 414 may be a rod, stick, pole, shaft, etc. The elongated body 414 may have a circular cross-section, square cross-section, a rectangular cross-section, a triangular cross-section, be frustoconical, have a tapering or variable cross-section, a combination of any of the previous cross-sections described, or the like. In one example, the elongated body 414 engages the distal tip 404 and platform 406 to frictionally fit within the housing. In another example, the elongated body 414 may be removably coupled to the distal tip 404 and/or platform 406 through a fastener, compression fit, or the like. Alternatively, the elongated body 414 is of one-piece construction being integrally formed with the housing 408. In yet another example, the elongated body 414 couples to the distal tip 404 and/or platform 406, while alternatively, the elongated body 414 merely extends adjacent the distal tip 404 and/or platform 406, but does not couple to the distal tip 404 and/or platform 406, instead coupling to a sidewall of a housing 408.

The elongated body 414 extends from a distal end 416 to a base 417 at a platform end 418. The elongated body 414 receives plural dampening masses 420A, 420B, 420C at different locations along the radial direction. In particular, the elongated body 414 includes a first portion 426 having a first diameter or width and a second portion 428 extending therefrom that has a second diameter or width that is less than the first diameter or width. As a result, a first stepped surface 430A is formed between the first portion 426 and second portion 428. In an example, when the first portion 426 and second portion 428 both have circular cross-sections, the first stepped surface 430A is an annular surface that may engage the annular surface of a corresponding first dampening mass 420A. The first dampening mass may then be moveable to, or alternatively may engage the first mass stop 422A. Alternatively, the first portion 526 may have a square cross-surface and the first stepped surface 430A may be a flange extending from the second portion and engage a flanged surface of the first dampening mass 420A. Specifically, the shape of the first portion, second portion, and dampening mass may be varied based on facilitating manufacturing, manufacturing costs, increasing surface area engagement between the first dampening mass 420A and the first stepped surface 430A or first mass stop 422A, or the like.

The elongated body 414 may also include a third portion 432 having a third diameter or width that extends from the second portion 428, where the third diameter or width may be less than the second diameter or width of the second portion 428. In this manner, a second stepped surface 430B may be formed similar to the first stepped surface 430A. The second stepped surface 430B may be of size and shape as described in relation to the first stepped surface 430A. To this end, the second stepped surface 430B may engage the second dampening mass 420B that engages the second mass stop 422B. In particular, the second mass stop 422B may be of size and shape to accommodate the second dampening mass 420B. In a similar manner, a fourth portion 434 may extend from the third portion 432 of the elongated body to form a third stepped surface 430C that engages the third dampening mass 420C. The third dampening mass 420C then is moveable to, or engages the third mass stop 422C similar to other dampening masses and mass stops described herein.

In the example of FIG. 4, the plural dampening masses 420A-C movably surround the elongated body 414 to move in relation to the elongated body 414. As an example, when the elongated body 414 has a circular cross section, each of the plural dampening masses 420A-C may be annular bodies, or doughnut shaped with a centrally located opening, or hole with a diameter that may be slightly larger than the diameter of the elongated body 414. While three dampening masses 420A-C are illustrated in the example embodiment of FIG. 4, in other example embodiments more or less dampening masses may be utilized.

In the example embodiment of FIG. 4, each of the plural dampening masses 420A-C has a corresponding mass stop 422A-C. Each corresponding mass stop 422A-C may be configured to prevent movement of the plural masses 420A-C relative to the elongated body 414. The plural mass stops 422A-C may be secured to the elongated body 414, be of one-piece construction with the elongated body, secured to the housing 408, be of one-piece construction with the housing 408, coupled to an intermediary structure secured to the housing, etc. In each example, similar to the elongated body, the plural mass stops 422A-C do not move relative to the housing. Alternatively, the elongated body may move relative to the housing, where the plural mass stops 422A-C do not move relative to the elongated body 414, or do move relative to the elongated body, but not relative to the housing 408. In example embodiments, there are the same number of plural mass stops 422A-C as plural masses 420A-C. In other embodiments, the number of plural mass stops 422A-C differs from the plural masses 420AC. Specifically, in some embodiments, the distal tip 404 or platform 406 may function as a mass stop without providing a separate mass stop accordingly. To this end, only a single mass stop may be provided for three separate masses. In such an embodiment, the distal tip 404 and/or platform 406 may be considered as mass stops as described herein.

Each mass stop 422A-C defines a movement path 424A-C for each mass 420A-C. The movement path is the path along the elongated body 414 each mass 420A-C moves. In particular, as the rotor rotates below a threshold speed, gravity overcomes the radial forces on each mass 420A-C such that each mass 420A-C remains in a first location of a movement path that positions each mass 420A-C closest to the platform 406, or results in movement of the mass 420A-C towards the platform. Once above the threshold radial force, the plural masses overcome gravity and frictional forces and begin moving radially away from the platform 406 toward the distal tip 404 until each mass 420A-C reaches a second location when each mass is closest to the distal tip 404. Specifically, each mass engages a mass stop 422A-C and is held against the mass stop 422A-C to provide friction damping until the rotation of the rotor slows and the speed of the rotor again falls below the threshold speed. In this manner, the dampening masses 420A-C may be disposed closer to a radial inward end of the elongated body 414 along the radial direction prior to rotation of the turbine blade around the rotation axis and the dampening masses 420A-C may be disposed farther from the radial inward end of the elongated body 414 along the radial direction during the rotation of the turbine blade around the rotation axis. Thus, the contact loading provided is only from the centrifugal load instead of from another load, such as an interference fit, to ensure that the contact loading does not change over time. In particular, when an interference fit is used, deformation over time results in loading changes. By having only the centrifugal load, such loading changes do not occur, improving functionality.

Additionally, by providing movable masses 420A-C, tuning of natural frequencies of the elongated body 414 and masses 420A-C may be determined and used to cover the blade modes of interest of the blade assembly 400. In particular, when the blade rotates the movable masses 420A-C are pushed outboard due to centrifugal loading and load up against the mass stops 422A-C. The elongated body 414 and masses 420A-C are designed such that there are several damper natural modes covering the frequency range of the critical blade modes. So, as the blade undergoes a resonant crossing the elongated body 414 also vibrates and forces the masses 420A-C to move laterally and rub against the mass stops 422A-C creating friction damping. Thus, the masses 420A-C may be designed such that the natural frequencies of the elongated body 414 and masses 420A-C cover the range of blade modes that need to be damped. When the blade vibrates, it excites the elongated body 414 and the attached masses 420A-C that dissipate energy either through impact or friction.

Specifically, in the example embodiment of FIG. 4, turbine damper 412 uses friction to provide the damping. In this embodiment, the plural masses 420A-C can be movable relative to and along the elongated body 414 in the radial direction, while the mass stops 422A-C can provide resting spots for the masses. The elongated body 414 can either be inserted directly in the blade or be assembled inside a housing and the entire elongated body housing assembly can then be inserted in the blade. Features that act as radial stops 422A-C for the masses 420A-C can either be cast in the blade or be manufactured as a part of the housing. Consequently, energy may be dissipated through friction between the elongated body mounted dampening masses 420A-C and the mass stops 422A-C.

While in the example embodiment of FIG. 4, only a single blade is illustrated, the turbine damper 412 may include plural elongated bodies, each to be used in a corresponding blade of a rotor. For example, in one example, the turbine damper 412 include a first elongated body that is within a first blade, such as blade 124 of FIG. 2, and also include a second elongated body that is within a second blade, such as blade 124A of FIG. 2. In particular, the turbine damper 412 includes each elongated body disposed within a blade of a blade assembly 400 that provides damping for the blade assembly.

Figure 5:
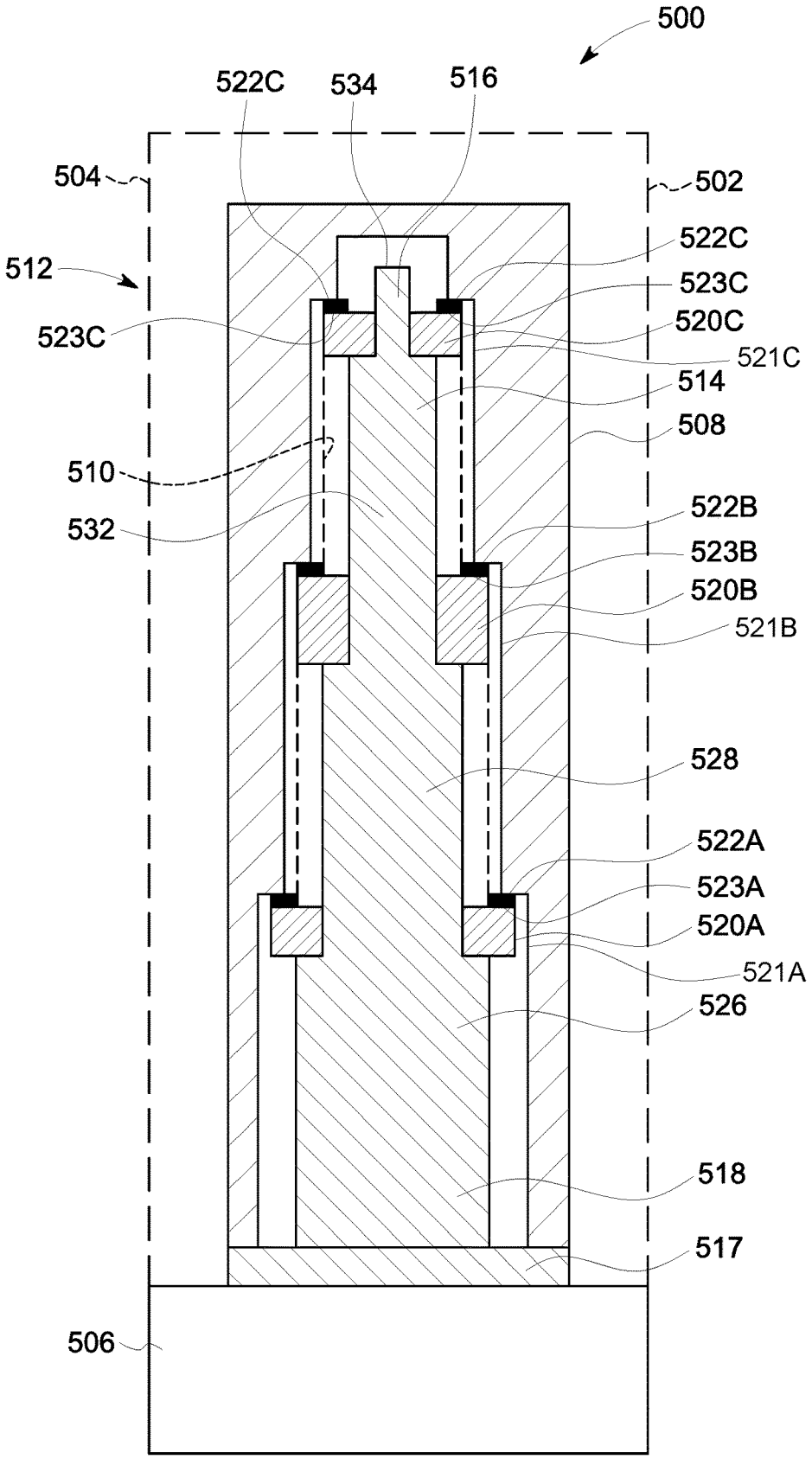
FIG. 5 is a side plan view with hidden lines of a blade assembly according to one embodiment.

FIG. 5 illustrates an alternative blade assembly 500. In one example, the blade assembly 500 may include the blade of FIGS. 2-3. Similar to the example embodiment of FIG. 4, the blade assembly 500 of FIG. 5 includes a friction based turbine damper. Similar to the blade assembly of FIG. 4, the blade assembly 500 of FIG. 5 includes an airfoil 502 that extends from a distal tip 504 to a platform 506. The airfoil 502 may be comprised of a housing 508 that includes a hollow interior 510 that extends from the distil tip 504 to a platform 506. In the example of FIG. 5, a separate housing 508 apart from the interior of the blade is illustrated. Disposed within the hollow interior may be a turbine damper 512 for dampening vibrations of the blade assembly 500.

The turbine damper 512 in the example of FIG. 5 may include an elongated body 514 that extends within the housing 508 from the distal end 516 to a base 517 at a platform end 518. In particular, the elongated body 514 may be elongated along a radial direction of the turbine blade relative to a rotation axis of the turbine blade. The elongated body 514 may be a rod, stick, pole, shaft, etc.

The elongated body 514 in the example embodiment of FIG. 5 has a variable diameter that receives the plural dampening masses 520A, 520B, 520C while the housing 508 provides the plural mass stops 522A, 522B, 522C. The plural dampening masses 520A-C may movably surround the elongated body 514 to move in relation to the elongated body 514. As an example, when the elongated body 514 has a circular cross section, each of the plural dampening masses 520A-C may be annular bodies, or doughnut shaped with a centrally located opening, or hole with a diameter that may be slightly larger than the diameter of the elongated body 514. In the example embodiment of FIG. 5 where the elongated body 514 includes varying stepped diameters, the dampening masses 520A-C may include varying hole diameters to accommodate the varying diameters of the elongated body 514.

By positioning the masses 520A-C to provide friction surfaces perpendicular to the spanwise direction (e.g., in the chord-wise and/or circumferential directions) of the turbine blade, improved dampening is provided. Specifically, elongated body 514 or masses 520A-C do not slide against spanwise-oriented blade surfaces such as surfaces 521A-C (e.g., in the spanwise-running inner wall of a blade channel oriented from dovetail/root to the blade tip). Instead, the masses 520A-C slide against surfaces 523A-C that are substantially perpendicular to the spanwise direction to provide the friction dampening. Thus, the contact loading between masses 520A-C and surfaces 523A-C can vary as a function of rotor rotational speed.

In one example, the plural mass stops 522A-C are formed integrally within the housing 508 as different steps that may include different diameters or widths that the masses can engage. In one example, the housing includes plural annular aligned bores, with each bore having a different diameter and forming a mass stop surface 523A, 523B, 523C accordingly. Alternatively, the aligned bores may have a cross-section other than a circular, and thus each aligned bore includes a differing width to again define mass stop surfaces 523A-C of the mass stops 522A-C.

Meanwhile, the elongated body 514 includes a first portion 526 having a first diameter or width and a second portion 528 extending therefrom that has a second diameter or width that is less than the first diameter or width. As a result, a first stepped surface 530A is formed between the first portion 526 and second portion 528. In an example, when the first portion 526 and second portion 528 both have circular cross-sections, the first stepped surface 530A is an annular surface that may engage the annular surface of a corresponding first dampening mass 520A. The first dampening mass may then be moveable to, or alternatively may engage the first mass stop 522A. Alternatively, the first portion 526 may have a square cross-surface and the first stepped surface 530A may be a flange extending from the second portion and engage a flanged surface of the first dampening mass 520A. Specifically, the shape of the first portion, second portion, and dampening mass may be varied based on facilitating manufacturing, manufacturing costs, increasing surface area engagement between the first dampening mass 520A and the first stepped surface 530A or first mass stop 522A, or the like.

The elongated body 514 may also include a third portion 532 having a third diameter or width that extends from the second portion 528, where the third diameter or width may be less than the second diameter or width of the second portion 528. In this manner, a second stepped surface 530B may be formed similar to the first stepped surface 530A. The second stepped surface 530B may be of size and shape as described in relation to the first stepped surface 530A. To this end, the second stepped surface 530B may engage the second dampening mass 520B that engages the second mass stop surface 523B of the second mass stop 522B. In particular, the second mass stop 522B may be formed in the housing similar to the first mass stop 522A, and may be of size and shape to accommodate the second dampening mass 520B. In a similar manner, a fourth portion 534 may extend from the third portion 532 of the elongated body to form a third stepped surface 530C that engages the third dampening mass 520C. The third dampening mass 520C then is moveable to, or engages the third mass stop surface 523C of the third mass stop 522C similar to other dampening masses and mass stops described herein.

Thus, the turbine damper 512 includes an elongated body 514 on which several movable dampening masses 520A-C are mounted. The elongated body 514 may be shaped in a stepped manner such that that each dampening mass 520A-C slides on an elongated body portion until a certain point. Similarly, stepped aligned bores with different sized sections may be machined on or in the blade or on or in a housing 508 such that the elongated body 514 of the turbine damper 512 can be inserted all the way in the aligned bores and each dampening mass 520A-C may be prevented from sliding along the elongated body 514 by a stepped surface of the elongated mass 514 and a mass stop of the housing 508.

When a blade including the turbine damper 512 of FIG. 5 rotates, the dampening masses 520A-520C are pushed outboard due to centrifugal loading and they load up against the mass stops 522A-C. The elongated body 514 and dampening masses 520A-C may be designed such that there are several damper natural modes covering the frequency range of the critical blade modes. So, as the blade undergoes a resonant crossing the elongated body 514 also vibrates and forces the dampening masses 520A-C to move laterally with the elongated body 514 to rub against each corresponding mass stop surface 523A-C of the housing, to create friction damping. For lower frequency modes the elongated body 514 may be expected to exhibit first flex motion and hence the dampening mass 520A adjacent the distal tip 504 is expected to provide the most damping. For higher order modes the other masses may also contribute significantly to the overall damping. In this manner, the dampening masses 520A-C may be sized for frequency tuning or may provide a contact load to generate friction damping.

While in the example embodiment of FIG. 5, only a single blade is illustrated, the turbine damper 512 may include plural elongated bodies, each to be used in a corresponding blade of a rotor. For example, in one example, the turbine damper 512 include a first elongated body that is within a first blade, such as blade 124 of FIG. 2, and also include a second elongated body that is within a second blade, such as blade 124A of FIG. 2. In particular, the turbine damper 512 includes each elongated body disposed within a blade of a blade assembly 500 that provides damping for the blade assembly.

Figure 6:
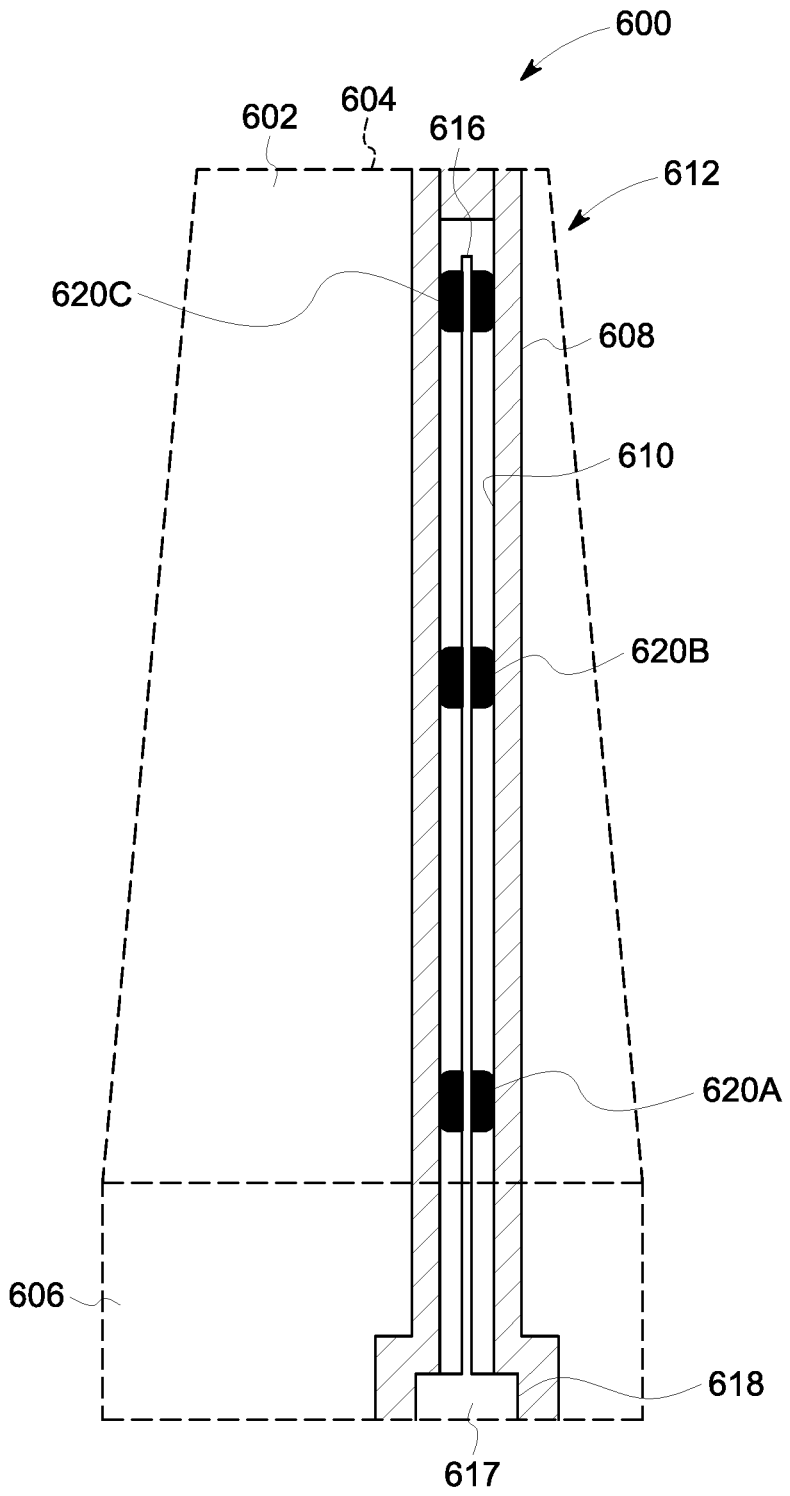
FIG. 6 is a side plan view with hidden lines of a blade assembly according to one embodiment.

FIG. 6 illustrates another example embodiment of a blade assembly 600. In one example, the blade assembly 600 may include the blade of FIGS. 2-3. Similar to the example embodiment of FIGS. 4-5, the blade assembly 600 of FIG. 6 may include an airfoil 602 that extends from a distal tip 604 to a platform 606. The airfoil 602 may be comprised of a housing 608 that includes a hollow interior 610 that extends from the distil tip 604 to the platform 606. Disposed within the hollow interior may be a turbine damper 612 for dampening vibrations of the blade assembly 600. In this example embodiment, instead of friction based energy dissipation, energy may be dissipated through impact between dampening masses and the housing, or internal walls of the blade.

The turbine damper 612 in the example of FIG. 6 may include and elongated body 614 that extends within the housing 608 from a distal end 616 to a base 617 at a platform end 618. In particular, the elongated body 614 may be elongated along a radial direction of the turbine blade relative to a rotation axis of the turbine blade. The elongated body 614 may be a rod, stick, pole, shaft, etc.

The elongated body 614 in the example embodiment of FIG. 6 includes plural dampening masses 620A, 620B, 620C that are secured thereto. In particular, the dampening masses may be fixed to the elongated body 614, may be of one piece construction with the elongated body 614, or the like such that the dampening masses 620A-C do not move in relation to the elongated body 614. Instead, the dampening masses 620A-C engage the housing 608 to transfer impact energy between the elongated body 614, dampening masses 620A-C, and housing 608. In one example, three dampening masses 620A-C may be provided, while in other examples only one dampening mass may be provided. Alternatively, more than five dampening masses or more may be provided.

In the embodiment of FIG. 6, the dampening masses 620A-C are rigidly attached on the elongated body 614. The elongated body 614 can be either inserted in a separate housing and can be inserted in the blade, or the elongated body 614 can directly be inserted in the blade.

The elongated body 614 and dampening masses 620A-C may be designed such that the natural frequency of the first few modes of the elongated body 614 covers the critical blade modes to be damped. Specifically, the dampening masses may be sized to dampen different vibration modes of the turbine blade. Specifically, a size of each of the dampening masses may be dictated based on the vibration mode experienced by the turbine blade at the location of the corresponding dampening mass. When the blade vibrates, the elongated body 614 may also undergo vibratory motion and the dampening masses 620A-C impact the inner walls of the blade (or housing) creating impact damping.

While in the example embodiment of FIG. 6, only a single blade is illustrated, the turbine damper 612 may include plural elongated bodies, each to be used in a corresponding blade of a rotor. For example, in one example, the turbine damper 612 include a first elongated body that is within a first blade, such as blade 124 of FIG. 2, and also include a second elongated body that is within a second blade, such as blade 124A of FIG. 2. In particular, the turbine damper 612 includes each elongated body disposed within a blade of a blade assembly 600 that provides damping for the blade assembly.

Thus, provided is a turbine damper that may result in larger, lighter gas turbine blades, including larger, lighter last stage blades. The turbine damper relies on friction or impact damping, which are proven damping technologies in turbomachinery. By using the internal turbine damper, other damping assemblies may be eliminated that are exterior to the turbine blade and can reduce size and overall performance of the rotor assembly.

In one or more embodiments, a turbine damper may be provided that may include an elongated body sized to fit inside a turbine blade, the elongated body elongated along a radial direction of the turbine blade relative to a rotation axis of the turbine blade, and plural dampening masses coupled with the elongated body and disposed at different locations along the radial direction. The plural dampening masses may be one or more of sized to dampen different vibration modes of the turbine blade, or moveable relative to and along the elongated body in the radial direction.

Optionally, the dampening masses may be sized for frequency tuning or providing contact load to generate friction damping.

Optionally, a size of each of the dampening masses may be dictated based on the vibration mode experienced by the turbine blade at the location of the corresponding dampening mass, and each of the dampening masses may not move relative to the elongated body.

Optionally, the dampening masses may be annular bodies extending around the elongated body and moveable relative to and along the elongated body in the radial direction.

Optionally, the locations of the dampening masses may be first locations along the radial direction of the turbine blade, and may also include mass stops disposed inside the turbine blade at different second locations along the radial direction of the turbine blade. The mass stops may be positioned inside the turbine blade to engage the dampening masses and stop radial movement of the dampening masses along the radial direction.

Optionally, each of the mass stops may be positioned inside the turbine blade to engage a different dampening mass of the dampening masses and stop the radial movement of the different dampening mass of the dampening masses.

Optionally, the elongated body may be stepped in diameter such that different segments of the elongated body that encompass different portions of a length of the elongated body in the radial direction have different diameters.

Optionally, the annular bodies of the dampening masses may have differently sized holes such that the annular bodies fit over different segments of the elongated body.

Optionally, the dampening masses may be disposed closer to a radial inward end of the elongated body along the radial direction prior to rotation of the turbine blade around the rotation axis and the dampening masses may be disposed farther from the radial inward end of the elongated body along the radial direction during the rotation of the turbine blade around the rotation axis.

In one or more embodiments, a turbine damper may be provided that may include an elongated body that may be sized to fit inside a turbine blade, the elongated body elongated along a radial direction of the turbine blade relative to a rotation axis of the turbine blade, and plural dampening masses may be coupled with the elongated body and disposed at different locations along the radial direction, wherein the dampening masses are sized to dampen different vibration modes of the turbine blade.

Optionally, the dampening masses may be sized to dampen the different vibration modes of the turbine blade such that a size of each of the dampening masses may be dictated based on the vibration mode experienced by the turbine blade at the location of the corresponding dampening mass.

Optionally, the dampening masses may be fixed in position along the elongated body.

Optionally, the elongated body may be a first elongated body, the dampening masses may be a first set of the dampening masses, and the turbine blade may be a first turbine blade. The turbine damper may also include a second elongated body that may be sized to fit inside a second turbine blade, the second elongated body elongated along a radial direction of the second turbine blade relative to a rotation axis of the second turbine blade. The turbine damper may also include plural second dampening masses coupled with the second elongated body and disposed at different locations along the radial direction of the second turbine blade. The second dampening masses may be one or more of (a) are disposed at the locations along the radial direction of the second turbine blade that differ from the locations of the first dampening masses along the radial direction of the first turbine blade or (b) have different sizes than the first dampening masses of the first turbine blade.

In one or more embodiment a turbine damper may be provided that may include an elongated body that may be sized to fit inside a turbine blade, the elongated body elongated along a radial direction of the turbine blade relative to a rotation axis of the turbine blade, and plural dampening masses coupled with the elongated body and disposed at different locations along the radial direction, The dampening masses may be moveable relative to and along the elongated body in the radial direction.

Optionally, the dampening masses may be annular bodies extending around the elongated body and moveable relative to and along the elongated body in the radial direction.

Optionally, the locations of the dampening masses may be first locations along the radial direction of the turbine blade. The turbine damper may also include mass stops disposed inside the turbine blade at different second locations along the radial direction of the turbine blade, the mass stops positioned inside the turbine blade to engage the dampening masses and stop radial movement of the dampening masses along the radial direction.

Optionally, each of the mass stops may be positioned inside the turbine blade to engage a different dampening mass of the dampening masses and stop the radial movement of the different dampening mass of the dampening masses.

Optionally, the elongated body may be stepped in diameter such that different segments of the elongated body that encompass different portions of a length of the elongated body in the radial direction have different diameters.

Optionally, the annular bodies of the dampening masses may have differently sized holes such that the annular bodies fit over different segments of the elongated body.

Optionally, the dampening masses may be disposed closer to a radial inward end of the elongated body along the radial direction prior to rotation of the turbine blade around the rotation axis and the dampening masses are disposed farther from the radial inward end of the elongated body along the radial direction during the rotation of the turbine blade around the rotation axis.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the inventive subject matter and also to enable a person of ordinary skill in the art to practice the embodiments of the inventive subject matter, including making and using any devices or systems and performing any incorporated methods. The patentable scope of the inventive subject matter is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the inventive subject matter will be better understood when read in conjunction with the appended drawings. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A turbine damper comprising:

an elongated body sized to fit inside and directly couple to a turbine blade such that the elongated body does not move relative to the turbine blade, the elongated body elongated along a radial direction of the turbine blade relative to a rotation axis of the turbine blade, wherein the elongated body is stepped in diameter such that different segments of the elongated body that encompass different portions of a length of the elongated body in the radial direction have different diameters; and plural dampening masses coupled with the elongated body and disposed at different locations along the radial direction, wherein the dampening masses are one or more of:

sized and positioned to dampen different vibration modes of the turbine blade, and moveable relative to and along the elongated body in the radial direction.

2. The turbine damper of claim 1, wherein the dampening masses are annular bodies extending around the elongated body and moveable relative to and along the elongated body in the radial direction.

3. The turbine damper of claim 2, wherein the locations of the dampening masses are first locations along the radial direction of the turbine blade, and further comprising:

mass stops disposed inside the turbine blade at different second locations along the radial direction of the turbine blade, the mass stops positioned inside the turbine blade to engage the dampening masses and stop radial movement of the dampening masses along the radial direction.

4. The turbine damper of claim 3, wherein each of the mass stops is positioned inside the turbine blade to engage a different dampening mass of the dampening masses and stop the radial movement of the different dampening mass of the dampening masses.

5. The turbine damper of claim 2, wherein the annular bodies of the dampening masses have differently sized holes such that the annular bodies fit over different segments of the elongated body.

6. The turbine damper of claim 2, wherein the dampening masses are disposed closer to a radial inward end of the elongated body along the radial direction prior to rotation of the turbine blade around the rotation axis and the dampening masses are disposed farther from the radial inward end of the elongated body along the radial direction during the rotation of the turbine blade around the rotation axis.

7. The turbine damper of claim 1, wherein the dampening masses are sized for frequency tuning or providing contact load to generate friction damping.

8. The turbine damper of claim 7, wherein a size of each of the dampening masses is based in part on the vibration mode experienced by the turbine blade at the location of the corresponding dampening mass.

9. The turbine damper of claim 7, wherein friction surfaces of the dampening masses are configured to be positioned perpendicular to a spanwise direction of the turbine blade.

10. A turbine damper comprising:

an elongated body sized to fit inside and directly couple to a turbine blade such that the elongated body does not move relative to the turbine blade, the elongated body elongated along a radial direction of the turbine blade relative to a rotation axis of the turbine blade, wherein the elongated body is stepped in diameter such that different segments of the elongated body that encompass different portions of a length of the elongated body in the radial direction have different diameters; and plural dampening masses coupled with the elongated body and disposed at different locations along the radial direction, wherein the dampening masses are moveable relative to and along the elongated body in the radial direction.

11. The turbine damper of claim 10, wherein the dampening masses are annular bodies extending around the elongated body and moveable relative to and along the elongated body in the radial direction.

12. The turbine damper of claim 10, wherein the locations of the dampening masses are first locations along the radial direction of the turbine blade, and further comprising:

mass stops disposed inside the turbine blade at different second locations along the radial direction of the turbine blade, the mass stops positioned inside the turbine blade to engage the dampening masses and stop radial movement of the dampening masses along the radial direction.

13. The turbine damper of claim 12, wherein each of the mass stops is positioned inside the turbine blade to engage a different dampening mass of the dampening masses and stop the radial movement of the different dampening mass of the dampening masses.

14. The turbine damper of claim 11, wherein the annular bodies of the dampening masses have differently sized holes such that the annular bodies fit over different segments of the elongated body.

15. The turbine damper of claim 10, wherein the dampening masses are disposed closer to a radial inward end of the elongated body along the radial direction prior to rotation of the turbine blade around the rotation axis and the dampening masses are disposed farther from the radial inward end of the elongated body along the radial direction during the rotation of the turbine blade around the rotation axis.

16. A turbine damper comprising:

an elongated body sized to fit inside and directly couple to a turbine blade such that the elongated body does not move relative to the turbine blade, the elongated body elongated along a radial direction of the turbine blade relative to a rotation axis of the turbine blade, wherein the elongated body is stepped in diameter such that different segments of the elongated body that encompass different portions of a length of the elongated body in the radial direction have different diameters; and plural dampening masses coupled with the elongated body and disposed at different locations along the radial direction, wherein the dampening masses are sized to dampen different vibration modes of the turbine blade, and wherein the dampening masses are annular bodies extending around the elongated body.

17. The turbine damper of claim 16, wherein the dampening masses are sized to dampen the different vibration modes of the turbine blade such that a size of each of the dampening masses is dictated based in part on the vibration mode experienced by the turbine blade at the location of the corresponding dampening mass.

18. The turbine damper of claim 16, wherein the dampening masses are fixed in position along the elongated body.

19. The turbine damper of claim 16, wherein the elongated body is a first elongated body, the dampening masses are a first set of the dampening masses, and the turbine blade is a first turbine blade, and further comprising:

a second elongated body sized to fit inside a second turbine blade, the second elongated body elongated along a radial direction of the second turbine blade relative to a rotation axis of the second turbine blade; and plural second dampening masses coupled with the second elongated body and disposed at different locations along the radial direction of the second turbine blade, wherein the second dampening masses one or more of (a) are disposed at the locations along the radial direction of the second turbine blade that differ from the locations of the first dampening masses along the radial direction of the first turbine blade or (b) have different sizes than the first dampening masses of the first turbine blade.

* * * * *